US006023821A

United States Patent [19]

Murray

[11] Patent Number: 6,023,821

[45] Date of Patent: Feb. 15, 2000

[54] SAFETY DEVICE IN A CLAMPING STRAP WITH CLAMP

[75] Inventor: Frederick G. Murray, Southington, Conn.

[73] Assignee: Industri AB Thule, Hillerstorp, Sweden

[21] Appl. No.: 09/112,522

[22] Filed: Jul. 9, 1998

[30] Foreign Application Priority Data

Jul. 11, 1997 [SU] U.S.S.R. ..... 9702723

[51] Int. Cl.[7] ..... A44B 11/00

[52] U.S. Cl. ..... 24/633; 24/16 R; 24/182; 24/573.1

[58] Field of Search ..... 24/633, 167, 168, 24/169, 172, 182, 196, 197, 265 C, 585, 16 R; 280/47.38; 297/482

[56] References Cited

U.S. PATENT DOCUMENTS

| | | | |
|---|---|---|---|
| Re. 4,871 | 4/1872 | Osborn | 24/182 |
| 69,628 | 10/1867 | McLain | 24/169 |
| 739,963 | 9/1903 | Westlen | 24/167 |
| 1,483,853 | 2/1924 | Schwerd | 24/585 |
| 4,675,954 | 6/1987 | Gullickson . | |
| 4,727,630 | 3/1988 | Alan | 24/633 |
| 5,098,162 | 3/1992 | Forget et al. . | |
| 5,129,129 | 7/1992 | Collins | 24/633 |
| 5,332,179 | 7/1994 | Kuffel et al. | 24/16 R |
| 5,442,840 | 8/1995 | Ewald . | |
| 5,617,617 | 4/1997 | Gustin . | |

FOREIGN PATENT DOCUMENTS 2220344 1/1990 United Kingdom .

*Primary Examiner*—Victor N. Sakran
*Attorney, Agent, or Firm*—Royston, Rayzor, Vickery, Novak & Druce, L.L.P.

[57] ABSTRACT

The disclosure relates to a safety device in a clamping strap (12) with a clamp (10). A casing (11) is designed for accommodating the clamp (10), and the casing (11) is designed with a first aperture (13) for insertion and removal of the clamp (10) and a second aperture (14) for passage of at least a part of the clamping strap (12). The casing is produced from a soft or elastic, preferably shock-absorbing material.

20 Claims, 1 Drawing Sheet

SAFETY DEVICE IN A CLAMPING STRAP WITH CLAMP

TECHNICAL FIELD

The present invention relates to a safety device in a clamping strap with a clamp, and may, for example, be employed to prevent damage to the paintwork of a motor vehicle if the clamping strap is employed for securing a load on a roof rack on the vehicle.

BACKGROUND OF THE INVENTION

Clamping straps are generally common in various types of transport. According to one well-known design, one end of a flat strap is secured in a clamp. The clamp or clasp is designed with a spring-biased locking plate which clamps against a part of the strap passed through the clamp so that the strap may readily be tightened about the load in question. As a rule, the clamp is manufactured from metal and may have sharp edges and corners. Furthermore, clamps of this type are often rather light in weight.

When a load is anchored on a load carrier, for example a roof rack on a motor vehicle, it is normal that the end portion of the clamping strap with the clamp is thrown over the load and the vehicle. If, in such instance, the clamp is light in weight, such a throwing action is difficult to carry out. In addition, there is a clear risk of damage to the paintwork of the vehicle if the clamp were to strike a painted surface. Nor can the risk of damage to a fragile load, or even personal injury if an assistant is employed, be discounted either.

PROBLEM STRUCTURE

The present invention has for its object to design the safety device intimated by way of introduction such that the drawbacks inherent in the prior art designs are obviated, and in particular the present invention has for its object to design a device such that throwing the clamping strap with the clamp is facilitated, at the same time, the risk of damage to vehicle paintwork or personal injury is eliminated or at least drastically reduced.

SUMMARY OF THE INVENTION

The objects forming the basis of the present invention will be attained if the safety device intimated by way of introduction is characterized in that a casing is designed for accommodating the clamp, and that the casing is designed with a first aperture for insertion and removal of the clamp, and a second aperture for passage of at least a part of the clamping strap.

DESCRIPTION OF THE ACCOMPANYING DRAWINGS

The present invention will now be described in greater detail hereinbelow, with the aid of one embodiment and with particular reference to the accompanying Drawings, in which.

DESCRIPTION OF THE INVENTION

Figure 1:
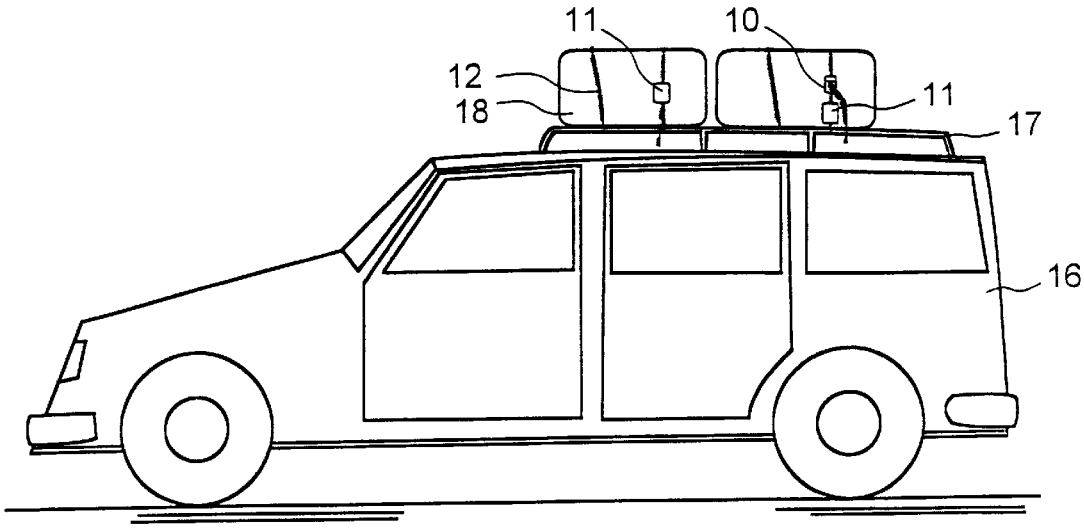
FIG. 1 is a schematic side elevation of a motor vehicle on which a load is fixedly clamped on a roof rack.

FIG. 1 schematically illustrates a motor vehicle 16 which is provided with a roof rack 17 of conventional design. A load 18 has been placed on the roof rack 17. The load 18 is fixedly damped by a clamping strap 12 which is secured in position by a clamp 10 taking the form of a buckle. The buckle 10 is configured for releasably securing two strap portions together. Clamping straps 12 of the design or clamp mechanism employed here are normally long and are passed several times around the load and the roof rack 17. When the clamping strap 12, and preferably that end on which the clamp 10 is secured, is to be passed around the load, the end portion of the clamping strap with the clamp is normally thrown over the load and the vehicle.

The clamp is normally of light metal or the like, which may entail that it might damage the vehicle paintwork or the load if it is not caught by some other means. It may also be the case that the clamp is relatively light in weight and therefore difficult to throw to the desired position. Nor can the risk of personal injury be discounted if an assistant is employed.

In FIG. 1, a safety device in the form of a casing is intimated at reference numeral 11, the casing being movable over the clamp 10, both when the clamp is thrown over the vehicle and later when the clamping strap 12 has been tightened. In the first-mentioned position, the casing 11 protects the vehicle paintwork and also the load proper, and further imparts the desired additional weight to the end of the clamping strap. In the second position, that surface which the clamp abuts against is protected. In this second position, the casing 11 also protects the clamp proper against the effects of the weather.

Figure 2:
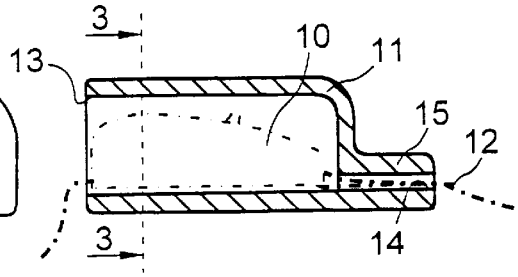
FIG. 2 is a sectional view showing a casing according to one embodiment of the present invention, with a clamp and a clamping strap shown in phantom.

FIG. 2 shows in greater detail how the casing 11 may be designed. Suitably, the casing is in the form of a flattened sleeve. The casing or sleeve 11 has a first aperture 13 through which the clamp 10 may be passed. In its opposing, other end, the casing or sleeve 11 is provided with a second aperture 14 through which the clamping strap 12 runs, preferably with a somewhat tight fit. The other end consists of a tapering portion 15, and the second aperture 14 is preferably of such dimensions that the clamping strap 12 slides with some resistance through the aperture such that the casing or sleeve 11 remains in position on the clamping strap.

Figure 4:
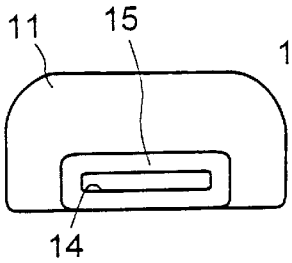
FIG. 4 is a plan view of the casing of FIG. 2.
Figure 3:
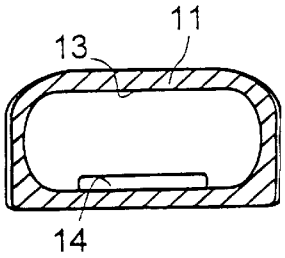
FIG. 3 is a sectional view taken along the line 3—3 in FIG. 2.

The cross section in FIG. 3 shows the configuration of the first aperture 13 and the outer contour of the sleeve or casing 11 as well. It will also be apparent from this Drawing Figure that the second aperture 14 is substantially centered in the transverse direction of the sleeve 11. Corresponding details are also apparent from FIG. 4.

When the sleeve 11 is put into use, the clamping strap 12 is passed in through the first aperture 13 and out through the second aperture 14. The clamping strap is thereafter drawn through the sleeve so that the clamp 10 is finally drawn in through the first, larger aperture 13. In this position, the clamp 10 is relatively reliably retained within the sleeve or casing 11. This may be achieved, on the one hand, in that the dimensions of the second aperture are selected such that the clamping strap is prevented from sliding through the aperture, and, on the other hand, in that the inner dimensions of the sleeve are selected such that the clamp 10 proper is pressed into and thereby fixedly retained in the sleeve.

Suitably, the sleeve 11 is made from a soft and elastic material, for example, plastic or other material of appropriate rigidity and weight. A shock-absorbing capability in the material of the casing is also advantageous. The material may possibly include a filler or extender for the purpose of increasing weight.

In this configuration, the strap end in which the clamp 10, and thereby the sleeve 11, is secured may be readily thrown over the load and the vehicle roof and drawn in a suitable manner around the roof rack or other securement platform. The clamp may be thrown back, and this cycle possibly repeated until the load is firmly anchored and the length of the clamping strap has been suitably utilized. The sleeve 11 is drawn a distance back over the clamping strap so that the clamp 10 becomes accessible. The free end of the clamping strap 12 is passed in through the clamp in a conventional manner and the clamp is tightened. The sleeve 11 may therefore, if desired, once again be drawn over the clamp 10 so that the load beneath is protected from the harder surface of the clamp.

While the safety device of the present invention has been described as being applied to a vehicle with a roof rack, it will be obvious to a person skilled in the art that it may also be applied in other situations where a corresponding safety need exists.

What is claimed is:

1. A safety device for a buckle configured to secure portions of a clamping strap, said safety device comprising:

a casing adapted to accommodate the buckle, which is configured to secure portions of the clamping strap, substantially within an interior space of said casing;

a first aperture through said casing for accommodating insertion and removal of the buckle into and out of said interior space of said casing; and a second aperture through said casing for accommodating passage of at least a portion of the clamping straps there through.

2. The safety device as recited in claim 1; wherein said first aperture is positioned substantially opposite to said second aperture across said casing.

3. The safety device as recited in claim 2; wherein said casing further comprises a tapering portion, said tapering portion terminating exteriorly of said casing in said second aperture.

4. The safety device as recited in claim 3; wherein said second aperture is configured so that a clamping strap frictionally fits therein for sliding reciprocation through said second aperture.

5. The safety devices recited in claim 4; wherein said interior space of said casing is configured so that the buckle installed into said interior space is frictionally restrained against withdrawal.

6. The safety device as recited an claim 5; wherein said casing is constructed from a yieldable material that establishes a shock-absorbing buffer between the buckle contained within said casing and contacted painted surfaces.

7. The safety device as recited an claim 6; wherein said casing is constructed from an elastic material that accommodates a snug frictional fit of said casing about the buckle.

8. The safety device as recited in claim 1; wherein said casing further comprises a weight for facilitating installation of a clamping strap about a load.

9. The safety device as recited in claim 1; wherein said casing further comprises a tapering portion, said tapering portion terminating exteriorly of said casing in said second aperture.

10. The safety device as recited in claim 1; wherein said second aperture is configured so that a clamping strap frictionally fits therein for sliding reciprocation through said second aperture.

11. The safety device as recited in claim 1; further comprising:

a clamping strap positioned within said casing; and said second aperture being configured so that said clamping strap frictionally fits therein for sliding reciprocation through said second aperture.

12. The safety device as recited in claim 1; wherein said interior space of said casing is configured so that a buckle installed into said interior space is frictionally restrained against withdrawal.

13. The safety device as recited in claim 1; further comprising:

a buckle positioned within said interior space of said casing; and said interior space of said casing being configured so that said buckle is frictionally restrained against withdrawal when installed into said interior space.

14. The safety device as recited an claim 1; wherein said casing is constructed from a yieldable material that establishes a shock-absorbing buffer between the buckle contained within said casing and contacted painted surfaces.

15. The safety device as recited an claim 1; wherein said casing is constructed from an elastic material that accommodates a snug frictional fit of said casing about the buckle.

16. The safety device as recited in claim 1; wherein said casing further comprises a weight for facilitating installation of a clamping strap about a load.

17. A safety device for a buckle connected upon a clamping strap wherein the buckle and safety device are adapted to be safely thrown across a carrying vehicle for securing a load thereupon without causing damage to the load or vehicle, said safety device comprising:

a casing adapted to accommodate the buckle of the clamping strap substantially within an interior space of said casing;

a first aperture through said casing configured to accommodate passage of a length of the clamping strap therethrough and to accommodate installation and removal of the buckle into and out of said interior space of said casing; and a second aperture through said casing configured to accommodate passage of the length of the clamping strap therethrough and to prevent passage of the buckle so that the length of clamping strap passes through said first aperture and out through said second aperture and the buckle is retained within said interior space of said casing.

18. A protective device for a buckle that is fastened to one end of a clamping strap wherein the protective device is adapted to prevent personal injury and property damage when the buckle and an adjacent strap portion fastened thereto are thrown across a vehicle for releasably securing a load upon the vehicle, said protective device comprising:

a protective cover adapted to accommodate the buckle therein;

first and second openings at opposite ends of said protective cover, said first opening being configured for insertion of the buckle into said protective cover and said second opening being configured as a passage through which the clamping strap extends; and said second opening being formed in an end wall of said protective cover and said end wall configured to be positioned at an end of the buckle facing the adjacent strap portion fastened to the buckle.

19. A protective clamping strap for anchoring a load on a carrying vehicle, said protective clamping strap comprising:

a strap having first and second ends;

said buckle connected at an end of said buckle to said first end of said strap and said buckle having an opposite end configured for securing a portion of said strap;

said protective cover defining an internal space for accommodating said buckle, said protective cover having an open end for insertion of said buckle into said internal space and an opposite end of said protective cover provided with an end wall, said end wall having an opening through which said strap extends thereby allowing said cover to be slid along said strap to a position where said buckle is accommodated within said internal space.

20. The invention as recited in claim 19, wherein said opening in said end wall is configured to prevent passage of said buckle therethrough.

* * * * *

UNITED STATES PATENT AND TRADEMARK OFFICE

CERTIFICATE OF CORRECTION

PATENT NO : 6,023,821

DATED : February 15, 2000

INVENTOR(S) : MURRAY

It is certified that error appears in the above-identified patent and that said Letters Patent is hereby corrected as shown below:

On the Title Page, item [30] - Foreign Application Priority Data, "[SU] U.S.S.R." should be -- [SE] Sweden--.

Column 3, line 27, "straps" should be --strap--.

Column 4, line 65, "said buckle" should be -- a buckle--.

Column 5, line 1, "said protective" should be -- a protective--

Signed and Sealed this

Twenty-first Day of November, 2000

*Attest:*

Q. TODD DICKINSON

*Attesting Officer*

*Director of Patents and Trademarks*